US008365826B2

(12) United States Patent
Braddick

(10) Patent No.: US 8,365,826 B2
(45) Date of Patent: Feb. 5, 2013

(54) HYDRAULICALLY POWERED FISHING TOOL AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 342 days.

(21) Appl. No.: 12/536,547

(22) Filed: Aug. 6, 2009

(65) Prior Publication Data

US 2011/0030955 A1 Feb. 10, 2011

(51) Int. Cl.
*E21B 31/113* (2006.01)

(52) U.S. Cl. ..... 166/301; 166/99; 166/98; 166/178

(58) Field of Classification Search ..... 166/301, 166/99, 98, 178
See application file for complete search history.

(56) References Cited

U.S. PATENT DOCUMENTS

| | | | |
|---|---|---|---|
| 5,070,941 | A | 12/1991 | Kilgore |
| 5,228,507 | A | 7/1993 | Obrejanu et al. |
| 5,370,180 | A | 12/1994 | Barbee |
| 5,398,753 | A | 3/1995 | Obrejanu et al. |
| 7,021,382 | B2 | 4/2006 | Angman et al. |
| 7,051,810 | B2 | 5/2006 | Clemens et al. |
| 7,367,397 | B2 | 5/2008 | Clemens et al. |

FOREIGN PATENT DOCUMENTS

GB 2160241 12/1995

*Primary Examiner* — David Andrews
(74) *Attorney, Agent, or Firm* — Streets & Steele

(57) ABSTRACT

A hydraulically powered fishing tool is provided for retrieving another tool or tubular stuck in a well. A tool housing is supported in a well on a work string, and the housing encloses a plurality of pistons (16, 28, 34) each movable in response to pressurized fluid transmitted through the work string. An anchor (52) axially fixes the position of the tool in the well, and a tool mandrel (40) is axially movable relative to tool housing when the anchor is set. A fishing device (82) engages the another tool or tubular, so that axial movement of the mandrel in response to the plurality of pistons dislodges the stuck tool or tubular.

17 Claims, 3 Drawing Sheets

HYDRAULICALLY POWERED FISHING TOOL AND METHOD

FIELD OF THE INVENTION

The present invention relates to fishing tools of the type used to retrieve another tool or a tubular which is stuck in a well. More particularly, this invention relates to a hydraulically powered fishing tool which is anchored in a well and generates a substantial axial force to dislodge the stuck tool or tubular.

BACKGROUND OF THE INVENTION

Hundreds of fishing tools have been devised over the years to retrieve a tool or tubular which is stuck in a well. In many applications, a wireline lowers the fishing tool into the well, and a grapple at the end of the tool engages the stuck tool or tubular. An upward force on the wireline may then be used to dislodge the tool. In other applications, hydraulically powered or mechanically powered jars are used to generate a jarring force to dislodge the stuck tool or tubular in a well. While many types of tools can be retrieved using the above techniques, more complicated and lengthy tools frequently cannot be reliably retrieved with the above techniques, or if retrieved cause significant damage to the stuck tool or to the components remaining in the well.

U.S. Pat. No. 5,070,941 discloses a downhole force generating tool with an anchor and a piston/cylinder arrangement. U.S. Pat. Nos. 5,228,507 and 5,398,753 disclose a wireline retrieving tool with an anchor and a force generating means, such as an electric motor generating power to operate a fluid motor and a hydraulic pump.

More recently, U.S. Pat. No. 7,051,810 discloses a force generating tool with a downhole power unit, an anchor, and a pulling tool. The power assembly may be self-contained, thereby eliminating the need to supply power from the surface.

U.S. Pat. No. 7,021,382 discloses an axial force generating tool with a housing and an outer seal between the housing and the borehole. A piston may be supplied with pressurized fluid to create the axial pulling force. U.S. Pat. No. 7,367,397 discloses an impact generator which includes a downhole power unit and a jarring tool.

The disadvantages of the prior art are overcome by the present invention, and an improved hydraulically powered fishing tool and a method of fishing a tool or tubular from a well are hereinafter disclosed.

SUMMARY OF THE INVENTION

A hydraulically powered fishing tool is provided for retrieving another tool or a tubular from the well. A tool housing is supported in the well by a work string, which in turn supports a plurality of axially stacked pistons each movable in response to pressurized fluid transmitted downhole on the workstring. A slip assembly provides an anchor for axially fixing the position of the tool housing in the well, and is movable to a set position in response to axial movement of the plurality of pistons. A tool mandrel axially moves relative to the tool housing when the anchor is set, and a grapple or other fishing device at a lower end of the tool mandrel engages the another tool or tubular, such that axial movement of the tool mandrel in response to the plurality of pistons dislodges the stuck tool or tubular.

In a typical application, the fishing tool of the present invention may be employed in applications that require greater tensile capacity to dislodge and release the fish than is conventionally available from either the rig and/or the workstring.

These and further features and advantages of the present invention will become apparent from the following detailed description, wherein reference is made to the figures in the accompanying drawings.

DETAILED DESCRIPTION OF PREFERRED EMBODIMENTS

Figure 1:
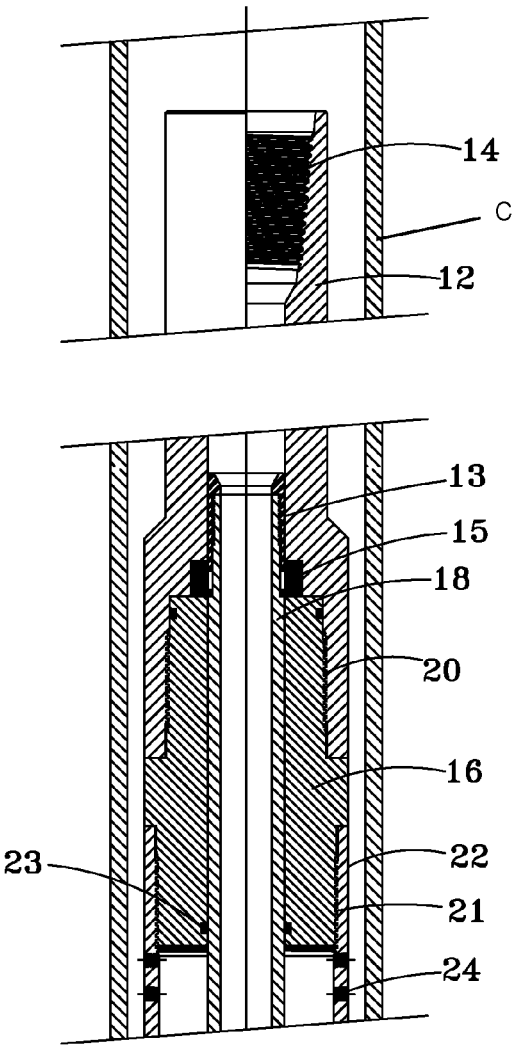
FIG. 1 is a cross-sectional view of an upper portion of the tool.

Referring now to FIG. 1, a fishing tool includes an upper connector 12 for interconnection with a lower end of the workstring via threads 14, thereby allowing the tool to be positioned within a well and within a casing C or other tubular in the well. Connector 12 is releasably connected to mandrel 18 by L-shaped shear ring 15, is threadably connected at 20 to outer piston 16, is threaded at 21 to outer sleeve or housing 22, and is sealed to the O.D. of mandrel 18 by seal 23. Shear ring 15 is held in position by retainer sleeve 13. Ports 24 allow for venting, as discussed subsequently.

Figure 2:
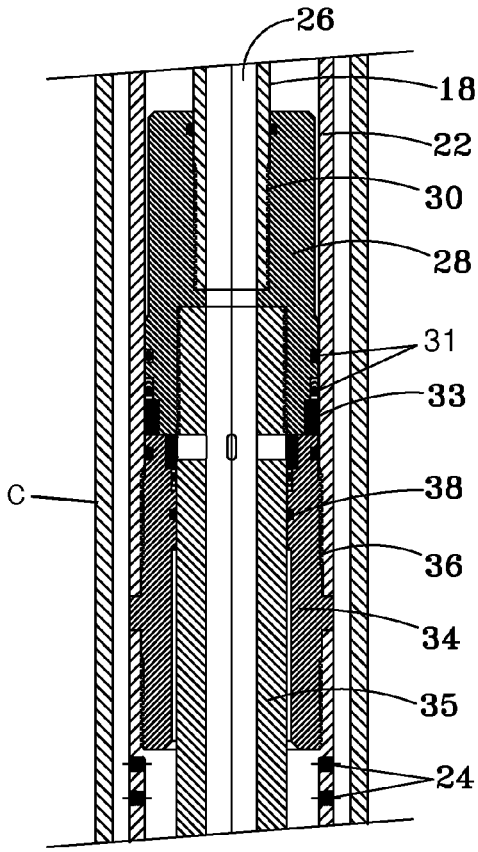
FIG. 2 is a cross-sectional view of a portion of the power section of the tool, including axially movable pistons.

FIG. 2 shows a lower portion of the tool, and a continuation of the mandrel 18 having a throughbore 26 therein. Inner piston 28 is sealed to the outer sleeve 22 by seals 32, and is threaded to the mandrel 18 by threads 30. The lower seal 31 may be a chevron-type seal held in place by retainer ring 33. Another outer piston 34 is threaded to the outer sleeve 22 by threads 36, with seals 38 sealing with the O.D. of the extended mandrel 35. Each of seal packages 31 and 38 are preferably different seals, e.g., one seal may be an o-ring seal and the adjacent seal may be a chevron-type seal held in place by a retainer.

Figure 3:
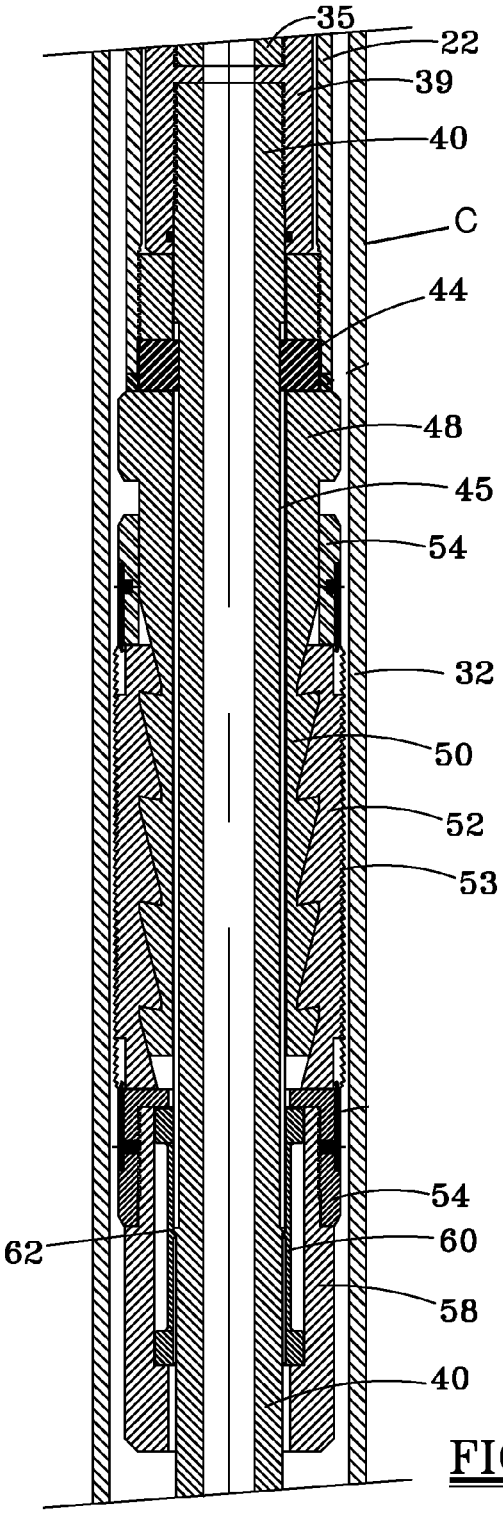
FIG. 3 is a cross-sectional view illustrating the slip assembly for anchoring the tool in a well.

Referring now to FIG. 3, the outer sleeve 22 is connected to a top of actuator 48, and connector 39 threaded to both mandrel 35 and to mandrel extension 40. Torque blocks 44 fit within pockets in the actuator 48, and slide within groove 45 so that the blocks rotate actuator 48, and thereby rotate the mandrel 40. The torque blocks thus transfer torque between the outer sleeve 22 and the mandrel 40. Actuator 48 includes a plurality of tapered actuator blocks 50 for engagement with a slip having similarly configured surfaces, so that when the actuator 48 moves downward relative to the slips 52, the teeth 53 are forced into biting engagement with the tubular 32 to serve as an anchor for the tool. The slip setting mechanism includes a cage 54 with radially positioned slip pockets or apertures. The lower end of cage 54 is threaded to cage block 58 having a collet mechanism 60 with a projection or other mechanism fitting within annular collet groove 62 in the O.D. of mandrel extension 40. Picking up on the work string thus raises the actuator and releases the slips to an unset position within the well. The collet assembly and the cage 54 move relative to mandrel 40 as actuator 48 moves downward to set slips 52.

Figure 4:
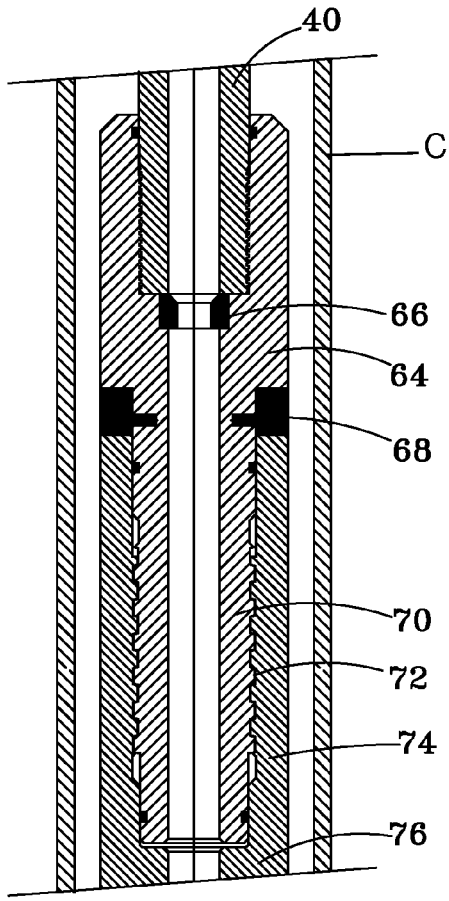
FIG. 4 illustrates a ball seat and release coupling of the tool.

FIG. 4 illustrates the mandrel extension 40 threaded to connector 64, which supports ball seat 66 thereon. Right-hand threads 72 on lower portion 70 of the tubular body 54 and similar threads on the interior of the upper end 74 of sleeve 76 thus provide a convenient way to release a lower portion of the tool from an upper portion of the tool, with the upper portion including the slip assembly and the plurality of pistons. FIG. 4 also depicts friction rings and retaining pin assembly 68 between the body 64 and the end of sleeve 76 to reduce the required breakout torque. The lower end of body 64 thus connects to sleeve 76, while the mating threads provide a reliable mechanism to release the upper portion of the tool from the lower portion of the tool, if necessary.

Figure 5:
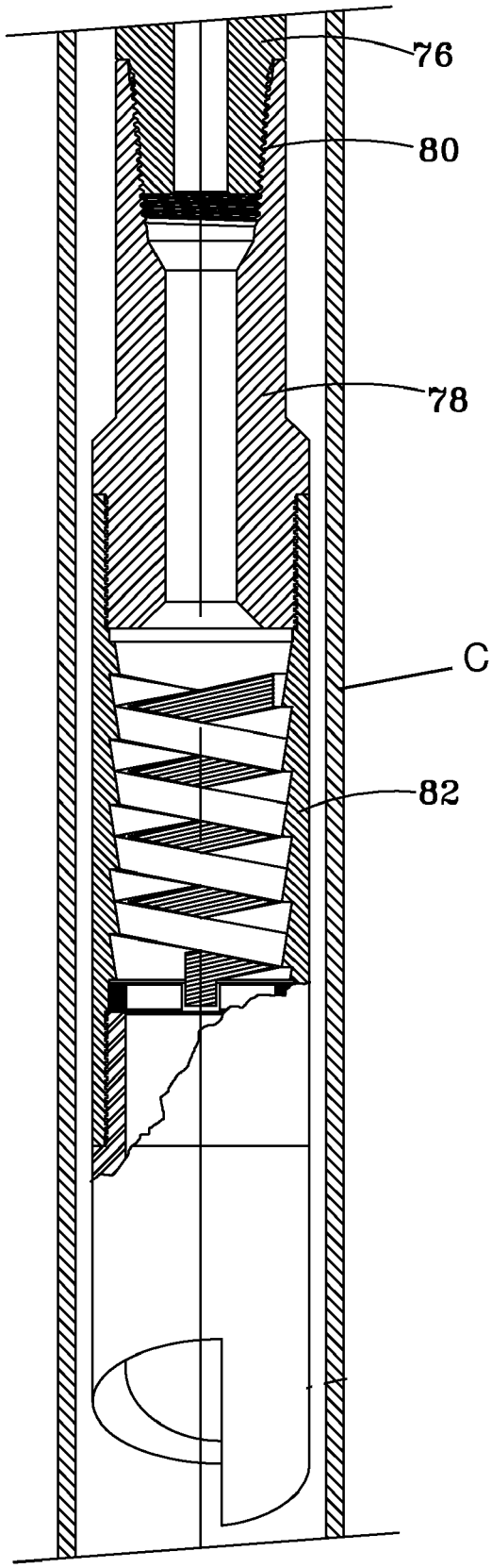
FIG. 5 illustrates a lower portion of the tool, including a grapple for engaging the another tool or tubular.

FIG. 5 illustrates a lower end of the sleeve 76, which includes the throughport in fluid communication with the throughport in the mandrel discussed above, and is threaded at 80 to connector 78, which in turn supports a fishing device, such as a grapple, a spear, a taper tap or any other type of fishing device 82 that is operated to engage the fish and break the fish loose by application of tensile forces.

A slip assembly as shown in FIG. 3 is a suitable mechanism serving as an anchor to axially position tool housing in the well. A slip mechanism is desirable since it may be moved to a set position in response to axial movement of the pistons, and since the mandrel axially moves with the grapple or other fishing tool or device in response to the same force from the pistons. More particularly, the axial force applied to the plurality of slips is reactive to the force exerted on the fishing device by the plurality of pistons, so as the force on the slips is increased, the engaging force of the fishing device is increased. Moreover, the forces generated by the pistons act simultaneously on the slip mechanism and on the tool mandrel.

Actuation of the fishing tool moves the plurality of pistons axially, which exerts a substantial tensile force on the fishing device and thus the fish secured to the device. The substantial force may break the fish free during upward movement of the fish for several inches or several feet. If the fish is broken free after the fishing tool is stroked, the normal action of resetting the tool moves the workstring and thus the tool upward in the well, and this upward movement may be continued rather than reset the tool, thereby retrieving the tool and the fish to the surface. If for some reason the tool is not broken free after being stroked, the tool may be reset in the well and may be stroked a second time or additional times until the fish becomes free, at which point the tool and fish may be retrieved to the surface.

A substantial force to dislodge the stuck tool or tubular is generated by actuating the plurality of pistons, and no pulling force on the work string is typically required to dislodge the stuck tool or tubular. Various types of fishing devices may be positioned at the lower end of the tool, and can connect to the tool or tubular stuck in the well, and the stuck tool or tubular can be reliably released by actuating the piston assembly to pull up on the mandrel relative to the set slips, thereby pulling up on the fishing device.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A hydraulically powered fishing tool for retrieving another tool or tubular stuck in a well, comprising:

a tool housing supported in a well by a work string and enclosing a plurality of axially stacked pistons generating a cumulative axial force, the tool housing including an outer sleeve, each of the plurality of pistons spaced radially between an inner tool mandrel and the outer sleeve, the outer sleeve interconnected with the work string, and each of the plurality of pistons axially movable in response to pressurized fluid transmitted downhole to the tool on the work string, the plurality of axially stacked pistons including a plurality of inner pistons each secured to the mandrel and a plurality of outer pistons each secured to the tool housing;

an anchor for axially fixing the position of the tool housing in a well, the anchor movable from a run-in position to a set position;

an anchor support for limiting downward movement of the anchor when the anchor is set, the anchor being releasable from the set position in response to axially upward movement of the work string;

a tool mandrel axially movable upward relative to the tool housing when the anchor is set; and a fishing device on a lower end of the tool mandrel for engaging the another tool or tubular, such that axial movement of the tool mandrel in response to axial movement of the plurality of pistons dislodges the stuck another tool or tubular.

2. A hydraulically powered fishing tool as defined in claim 1, wherein the axial force generated by the plurality of pistons acts simultaneously on the anchor and on the tool mandrel, such that the tool anchoring force increases when the axial force on the tool mandrel increases.

3. A hydraulically powered fishing tool as defined in claim 1, wherein the anchor includes a plurality of slips circumferentially spaced about the mandrel for secured engagement with an interior wall in the well.

4. A hydraulically powered fishing tool as defined in claim 3, wherein an axial force applied to the plurality of slips is reactive to the force exerted on the fishing device by the plurality of pistons.

5. A hydraulically powered fishing tool as defined in claim 1, further comprising:

a right-hand threaded coupling interconnected to the mandrel for selectively releasing an upper portion of the tool from a lower portion of the tool.

6. A hydraulically powered fishing tool for retrieving another tool or tubular stuck in a well, comprising:

a tool housing supported in a well by a work string and enclosing a plurality of axially stacked pistons generating a cumulative axial force, the tool housing including an outer sleeve, each of the plurality of pistons spaced radially between an inner tool mandrel and the outer sleeve, the outer sleeve interconnected with the work string, and each of the plurality of pistons axially movable in response to pressurized fluid transmitted downhole to the tool on the work string, the plurality of axially stacked pistons including a plurality of inner pistons each secured to the mandrel and a plurality of outer pistons each secured to the tool housing;

a slip assembly for axially fixing the position of the tool housing in a well, the slip assembly movable from a run-in position to a set position in response to axial movement of the plurality of pistons;

an anchor support for limiting downward movement of the anchor when the anchor is set, the anchor being releasable from the set position in response to axially upward movement of the work string;

a tool mandrel axially movable upward relative to the tool housing when the anchor is set;

the plurality of axially stacked pistons including a plurality of inner pistons each secured to the mandrel and a plurality of outer pistons each secured to the tool housing; and a fishing device on a lower end of the tool mandrel for engaging the another tool or tubular, such that axial movement of the tool mandrel in response to axial movement of the plurality of pistons dislodges the stuck another tool or tubular.

7. A hydraulically powered fishing tool as defined in claim 6, wherein the axial force generated by the plurality of pistons acts simultaneously on the anchor and on the tool mandrel, such that the tool anchoring force increases when the axial force on the tool mandrel increases.

8. A hydraulically powered fishing tool as defined in claim 6, wherein the slip assembly includes a plurality of slips circumferentially spaced about the mandrel for secured engagement with an interior wall in the well.

9. A hydraulically powered fishing tool as defined in claim 8, wherein an axial force applied to the plurality of slips is reactive to the force exerted on the fishing device by the plurality of pistons.

10. A hydraulically powered fishing tool as defined by claim 6, further comprising:

a right-hand threaded coupling interconnected to the mandrel for selectively releasing an upper portion of the tool from a lower portion of the tool.

11. A method of retrieving a tool or tubular stuck in a well, comprising:

supporting a tool housing in a well by a work string;

supporting a plurality of axially stacked pistons within the tool housing for generating a cumulative axial force, the tool housing including an outer sleeve, each of the plurality of pistons axially movable and spaced radially between an inner tool mandrel and the outer sleeve, the outer sleeve interconnected with the work string, and each of the plurality of pistons axially movable in response to pressurized fluid transmitted downhole to the tool on the work string, the plurality of axially stacked pistons including a plurality of inner pistons each secured to the mandrel and a plurality of outer pistons each secured to the tool housing;

axially fixing the position of the tool housing in a well with an anchor, the anchor movable from a run-in position to a set position;

limiting downward movement of the anchor by an anchor support while the anchor is set, the anchor being releasable from the set position in response to axially upward movement of the work string;

axially moving a tool mandrel upward relative to the tool housing in response to the plurality of pistons when the anchor is set; and providing a fishing device on a lower end of the tool mandrel for engaging the tool or tubular, such that axial movement of the tool mandrel in response to axial movement of the plurality of pistons dislodges the stuck tool or tubular.

12. A method as defined in claim 11, wherein the plurality of axially stacked pistons include a plurality of inner pistons each secured to the mandrel and a plurality of outer pistons each secured to the tool housing.

13. A method as defined in claim 11, wherein the axial force generated by the plurality of pistons acts simultaneously on the anchor and on the tool mandrel, such that the tool anchoring force increases when the axial force on the tool mandrel increases.

14. A method as defined in claim 11, wherein the anchor includes a plurality of slips circumferentially spaced about the mandrel for secured engagement with an interior wall in the well.

15. A method as defined in claim 14, wherein the anchor is set in response to axial movement of the plurality of pistons.

16. A method as defined in claim 15, wherein an axial force applied to the plurality of slips is reactive to the force exerted on the fishing device by the plurality of pistons.

17. A method as defined in claim 11, further comprising:

providing a right-hand threaded coupling interconnected to the mandrel for selectively releasing an upper portion of the tool from a lower portion of the tool.

* * * * *